US007174711B2

(12) United States Patent
Nanjo et al.

(10) Patent No.: US 7,174,711 B2
(45) Date of Patent: Feb. 13, 2007

(54) HYDRAULIC CONTROL SYSTEM AND CONSTRUCTION MACHINE

(75) Inventors: Takao Nanjo, Kobe (JP); Naoki Sugano, Kobe (JP); Etsujiro Imanishi, Kobe (JP); Yutaka Toji, Hiroshima (JP); Hidekazu Oka, Hiroshima (JP)

(73) Assignee: Kobelco Construction Machinery Co., Ltd., Hiroshima (JP)

( * ) Notice: Subject to any disclaimer, the term of this patent is extended or adjusted under 35 U.S.C. 154(b) by 72 days.

(21) Appl. No.: 11/086,392

(22) Filed: Mar. 23, 2005

(65) Prior Publication Data

US 2005/0229594 A1 Oct. 20, 2005

(30) Foreign Application Priority Data

Mar. 31, 2004 (JP) ..... 2004-105626

(51) Int. Cl.
*F15B 11/15* (2006.01)
*F15B 21/04* (2006.01)

(52) U.S. Cl. ..... 60/484; 60/486

(58) Field of Classification Search ..... 60/405, 60/421, 484, 486

See application file for complete search history.

(56) References Cited

U.S. PATENT DOCUMENTS 3,720,059 A * 3/1973 Schurawski et al. ..... 60/421
3,817,153 A * 6/1974 Zunzer ..... 60/405
4,561,341 A * 12/1985 Aikawa ..... 60/484
4,738,103 A 4/1988 Tha
5,235,811 A * 8/1993 Arii et al. ..... 60/484
5,577,435 A * 11/1996 Kowalyk et al. ..... 60/421

FOREIGN PATENT DOCUMENTS

JP 7-180190 7/1995
JP 9-317879 12/1997
JP 2002-89505 3/2002

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A hydraulic control system of the present invention comprising control valves for controlling the direction and flow rate of pressure oil discharged from a hydraulic pump, hydraulic actuators which the pressure oil is fed to and controlled by the control valves, the hydraulic actuators including hydraulic cylinders and a hydraulic motor, and a first return passage provided as a passage for returning return oil present at the head side of one of the hydraulic cylinders to the tank, the first return passage being in communication with the tank, and a second return passage for returning return oil from each of the other hydraulic actuators including the hydraulic motor except for the hydraulic cylinders to the tank, the second return passage having a back pressure check valve and a replenishing passage, the replenishing passage being configured so as to provide a back pressure developed by the back pressure check valve to the low pressure side of each of the other hydraulic actuators to prevent cavitations.

6 Claims, 3 Drawing Sheets

HYDRAULIC CONTROL SYSTEM AND CONSTRUCTION MACHINE

BACKGROUND OF THE INVENTION

1. Field of the Invention

The present invention relates to a hydraulic control system for controlling hydraulic driven actuators and a construction machine using the hydraulic control system.

2. Description of the Related Art

In a hydraulic excavator, when a swing motion is to be stopped, a control valve for a swing motor is returned to its neutral position to cut off a supply of pressure oil from a hydraulic pump to the swing motor. However, since the swing motor continues to rotate for a certain time due to a large inertia of an upper rotating body, there occur cavitations.

Further, if an arm cylinder is extended in the air and an arm pulling operation is performed while an engine speed is set in a low idling condition, the arm pulling operation is accelerated under the action of the arm weight and hence pressure oil fed to the head side of the arm cylinder becomes short. In such a case, there also occur cavitations.

The following methods have been proposed as means for decreasing a loss of energy while preventing cavitations.

(a) A pilot pressure of a traveling/rotating operation pilot valve is detected through a shuttle valve and is conducted to a back pressure proof valve, while a back pressure is developed in the back pressure valve in traveling and rotating operation to prevent an occurrence of cavitations, while in other operations the back pressure is not developed to decrease the loss of energy (see, for example, Japanese Patent Laid-Open No. Hei 7-180190).

(b) A drive-side pressure of a hydraulic motor or a hydraulic pump pressure is taken out as a pilot pressure, and a variable throttle valve which utilizes the said pilot pressure to switch a back pressure to a low or high pressure is provided in a back pressure circuit (see, for example, Japanese Patent Laid-Open No. Hei 9-317879).

(c) A bypass valve is disposed in a bypass which is formed in parallel with a back pressure check valve and is closed only when a hydraulic actuator is stopped, causing a back pressure to be developed by the back pressure check valve (see, for example, Japanese Patent Laid-Open No. 2002-89505).

The cavitation preventing circuit in the above (a) and (b) is configured so as to make prevention of cavitations and decrease of energy loss compatible with each other by switching the condition of back pressure which is for preventing the cavitations of a swing motor (rotating motor) and a travel motor. However, no consideration is given, for example, to hydraulic cylinders for actuating a front attachment and it is impossible to decrease the loss of energy throughout the whole hydraulic control circuit.

In the case of an actuator wherein an incoming flow rate and an outgoing flow rate are equal as in a hydraulic motor, the outgoing flow rate does not exceed the incoming flow rate from a hydraulic pump, but in case of a hydraulic cylinder, cavitations are apt to occur when the cylinder is extended in its extending direction due to a difference in sectional area between an oil chamber formed on the head side and an oil chamber on the loss side. Conversely, however, in case of operating the hydraulic cylinder in its retracting direction, the outgoing-side flow rate is large and a back pressure is developed due to the resulting pressure loss of an actuator pipe. Therefore, cavitations are difficult to occur. In the conventional circuit for the prevention of cavitations, return oil flows through a back pressure circuit also in the cylinder retracting direction, so that the loss of energy is large. It is necessary to decrease such energy loss generated in the hydraulic cylinder.

In the cavitation preventing circuit in the above (c), a negative control pressure is utilized for closing the bypass valve, and only when all the actuators (hydraulic motor and hydraulic cylinders) are stopped, the bypass valve is closed with a negative control pressure and a back pressure is generated by the back pressure check valve. On the other hand, while the actuators are not stopped, the bypass valve is opened, allowing the back pressure check valve to function as a bypass to prevent the loss of energy. According to this configuration, the loss of energy cannot be decreased in the case where the hydraulic cylinders are operated each independently.

SUMMARY OF THE INVENTION

It is an object of the present invention to provide a hydraulic control system (hydraulic control circuit) including a hydraulic motor and hydraulic cylinders which system can effectively decrease the loss of energy generated in the hydraulic cylinders while preventing cavitations, as well as a construction machine using the hydraulic control system.

The hydraulic control system and a construction machine according to the present invention comprise, as a basic configuration thereof, a hydraulic pump, control valves for controlling a direction and flow rate of pressure oil discharged from the hydraulic pump, and hydraulic actuators which the pressure oil is fed to and controlled by the control valves. In the hydraulic actuators are included hydraulic cylinders and a hydraulic motor. In the hydraulic control system are further provided a return passage adapted to conduct return oil from the hydraulic actuators to a tank, the return passage comprising a first return passage adapted to conduct return oil present at the head side of one of the hydraulic cylinders to the tank, the first return passage being in communication with the tank, and a second return passage adapted to conduct return oil from each of the other hydraulic actuators including the hydraulic motor than the hydraulic cylinders to the tank, the second return passage having a back pressure check valve and a replenishing passage. The replenishing passage is configured so as to provide a back pressure developed by the back pressure check valve to the low pressure side of each of the other hydraulic actuators to prevent cavitations.

In this case, the return oil from the head side of the hydraulic cylinder at the time of a retracting motion of the hydraulic cylinder does not flow through the second return passage provided with the back pressure check valve, but returns to the tank through the first return passage communicating with the tank, so that the occurrence of energy loss is diminished.

Thus, it is possible to effectively decrease the loss of energy generated in each hydraulic cylinder while preventing the cavitations in the hydraulic control circuit including the hydraulic motor and hydraulic cylinders.

The construction machine using the hydraulic control system configured as above comprises as the hydraulic actuators a bucket cylinder, an arm cylinder, a boom cylinder, the cylinders being provided in a front attachment, and a swing motor for rotating an upper rotating body, wherein the first return passage is provided in each of the cylinders, and when one of the hydraulic cylinders and the swing motor are operated simultaneously, return oil from the swing motor and return oil present at the rod side of the one of hydraulic cylinders are returned to the tank through the second return passage to develop a back pressure, while return oil at the head side of the one of hydraulic cylinders is returned to the tank through the first return passage so as not to develop a back pressure.

In the construction machine according to the present invention, even when the hydraulic actuators are operated simultaneously, it is possible to diminish the loss of energy while preventing the cavitations for each of the hydraulic actuators.

DESCRIPTION OF THE PREFERRED EMBODIMENTS

Figure 1:
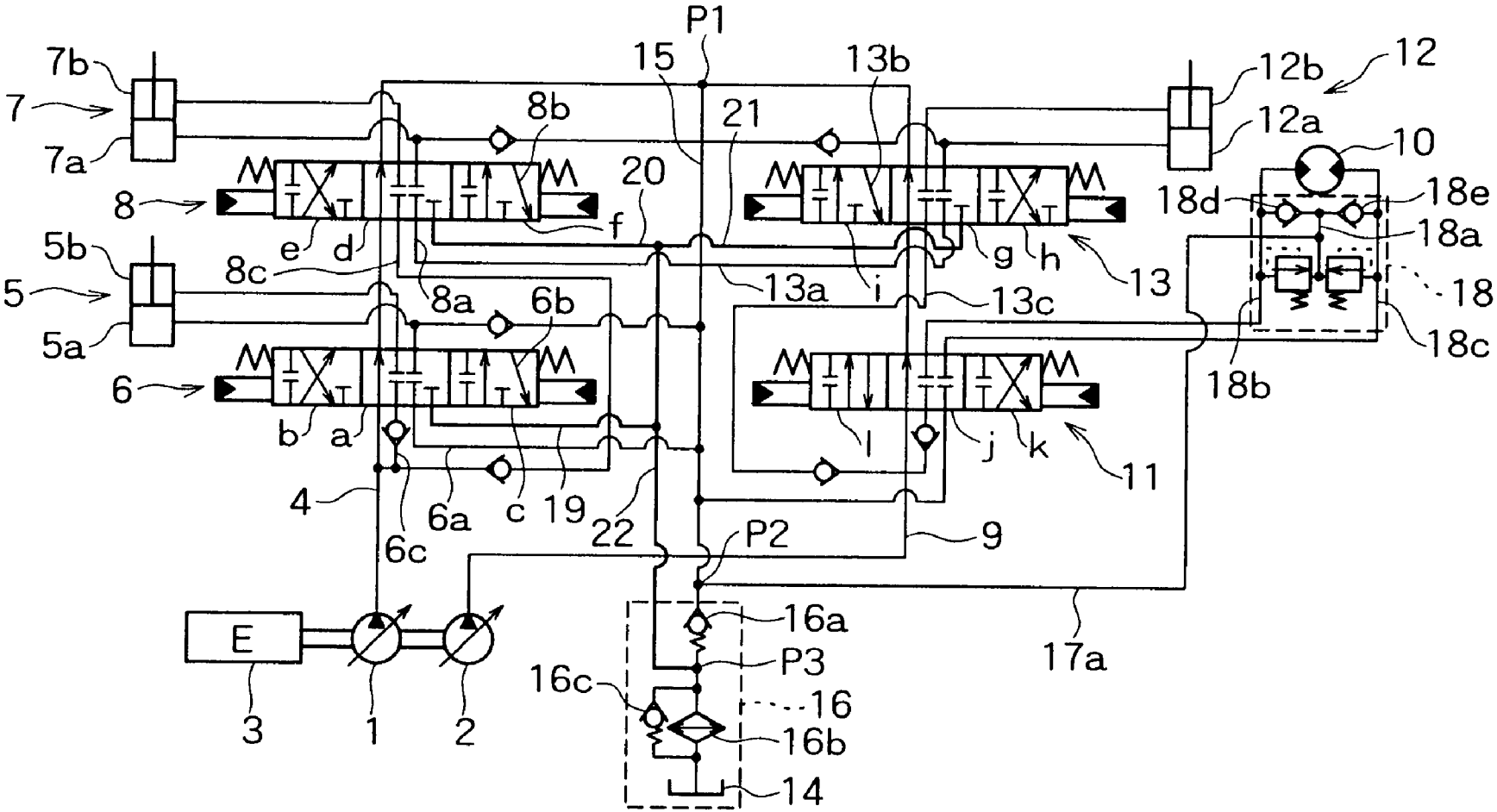
FIG. 1 shows a hydraulic control circuit according to a first embodiment of the present invention.

The hydraulic control circuit according to the present invention basically comprises control valves for controlling the direction and flow rate of pressure oil discharged from a hydraulic pump, hydraulic actuators which the pressure oil is fed to and controlled by the control valves, and a return passage for conducting return oil from the hydraulic actuators to a tank, wherein hydraulic cylinders and a hydraulic motor are provided as the hydraulic actuators, return oil at the head side of at least one of the hydraulic cylinders is returned to the tank through a first return passage communicating with the tank, while return oil from the other hydraulic actuators including the hydraulic motor is returned to the tank through a second return passage, the second return passage having a back pressure check valve and a replenishing passage for providing a back pressure developed by the back pressure check valve to low pressure sides of the hydraulic actuators to prevent cavitations.

The present invention will be described in detail hereinunder on the basis of embodiments thereof illustrated in the drawings.

FIG. 1 shows a hydraulic control circuit in a construction machine according to an embodiment of the present invention.

A hydraulic excavator as the construction machine includes, as hydraulic actuators, a swing motor for rotating an upper rotating body and hydraulic cylinders for operating a front attachment attached to the upper rotating body. A construction work is performed by operating the hydraulic actuators in each individual manner or a composite manner.

In FIG. 1, numerals 1 and 2 denote a first hydraulic pump and a second hydraulic pump, respectively, of a variable capacity type, and numeral 3 denotes an engine as a drive source for activating both pumps 1 and 2.

Pressure oil discharged from the first hydraulic pump 1 is fed to a bucket control valve 6 disposed on a first center bypass line 4 to drive a bucket cylinder 5 and also to a boom control valve 8 disposed on the first center bypass line 4 to drive a boom cylinder 7.

Pressure oil discharged from the second hydraulic pump 2 is fed to a rotating control valve 11 disposed on a second center bypass line 9 to drive a swing motor 10 and also to an arm control valve 13 disposed on the second center bypass line to drive an arm cylinder 12.

The bucket cylinder 5, boom cylinder 7 and arm cylinder 12 actuate a bucket, an arm and a boom (none of them are shown) respectively which constitute a front attachment in the hydraulic excavator. The swing motor 10 is for rotating an upper rotating body (not shown).

The downstream side of the boom control valve 8 in the first center bypass line 4 and the downstream side of the arm control valve 13 in the second center bypass line 9 join at a confluence point P1 and are connected to a second return oil path (second return passage) 15 which communicates with a tank 14. As to a first return oil path, a description will be given later.

A back pressure circuit 16 is provided in the second return oil passage 15. Aback pressure check valve 16*a* for generating a back pressure in the second return oil path 15, an oil cooler 16*b* for cooling return oil having an elevated temperature after use for operation of the actuators, and a bypass check valve 16*c* for protecting the oil cooler 16*b*, are provided in the back pressure circuit 16.

The back pressure check valve 16*a* is constituted by a check valve which is biased with a preset force by means of a spring. The back pressure check valve 16*a* produces a pressure preset by the spring, i.e., a back pressure on its upstream side.

A point P2 located on the upstream side of the back pressure check valve 16*a* is connected to a pressure oil supply path 18*a* in a motor drive circuit 18 through a replenishing passage 17*a*. According to this configuration, in the case where one of pressure oil feeding/discharging paths 18*b* and 18*c* becomes low in pressure (somewhat negative in pressure) while the swing motor 10 is stopped, pressure oil is replenished from the pressure oil supply path 18*a* to the swing motor 10 through one of a pair of check valves 18*d* and 18*e*.

The bucket control valve 6 has a neutral position a, an extensional position b to which the valve switches when a bucket pulling operation is performed, and a retractive position c to which the valve switches when a bucket pushing operation is performed. In the retractive position c is newly provided a switching passage 6*b* for conducting pressure oil discharged from a head-side oil chamber 5*a* to a dedicated return oil path 19 which is provided separately from a discharge path 6*a*. Numeral 6*c* denotes a supply path.

The boom control valve 8 has a neutral position d, an extensional position e to which the valve switches when a boom raising operation is performed, and a retractive position f to which the valve switches when a boom lowering operation is performed. In the retractive position f is newly provided a switching passage 8*b* for conducting pressure oil discharged from a head-side oil chamber 7*a* to a dedicated return oil path 20 which is provided separately from a discharge path 8*a*. Numeral 8*c* denotes a supply path.

The arm control valve 13 has a neutral position g, an extensional position h to which the valve switches when an arm pulling operation is performed, and a retractive position i to which the valve switches when an arm pushing operation is performed. In the retractive position i is newly provided a switching passage 13*b* for conducting pressure oil discharged from a head-side oil chamber 12*a* to a dedicated return oil path 21 which is provided separately from a discharge path 13*a*. Numeral 13*c* denotes a supply path.

The rotating control valve 11, which is of the same configuration as in the related art, has as switching positions a neutral position j, a right rotating position k and a left rotating position l.

The dedicated return oil paths 19, 20 and 21 join in a first return oil path (first return passage) 22. The first return oil path 22 is connected to a downstream-side position P3 of the back pressure check valve 16*a* in the back pressure circuit 16.

As described above, it is preferable that the switching passages 6*b*, 8*b* and 13*b* be incorporated within the control valves, the switching passages 6*b*, 8*b* and 13*b* providing connections of the head-side return oil in the hydraulic cylinders to the first return oil path 22 when the respective control valves 6, 8 and 13 are in their hydraulic cylinder retracting positions.

Figure 2:
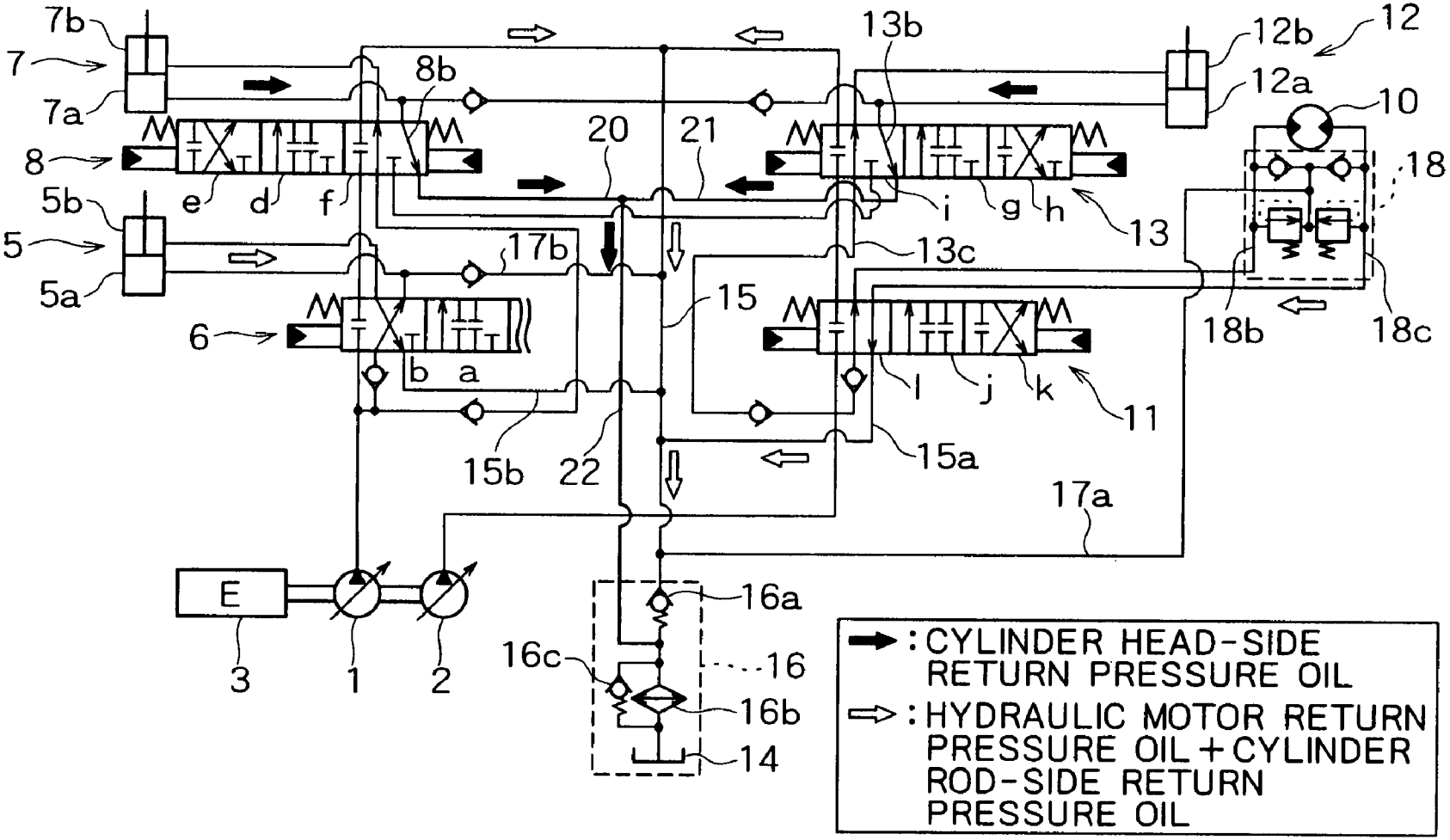
FIG. 2 is an explanatory diagram explaining an operation of the hydraulic control circuit shown in FIG. 1.

The operation of the above hydraulic control circuit will be described below with reference to FIG. 2.

In the same figure, black arrows indicate directions of cylinder head-side return oil and white arrows indicate directions of both hydraulic motor return oil and cylinder rod-side return oil. The pressure oil flows shown in the same figure are of the case where the four actuators are operated simultaneously. The boom cylinder 7 and the arm cylinder 12 are assumed to be operated so that their head sides are return oil sides, while the bucket cylinder 5 is assumed to be operated so that its rod side is a return oil side.

When operation of the hydraulic motor 10 and a cylinder extending operation are performed, return oil from these hydraulic actuators is conducted to the second return oil path 15 as in the related art. As to the cylinder extending operation, reference will be made below to the bucket cylinder 5 as an example.

When the rotating control valve 11 is switched to, for example, the left rotating position 1, the pressure oil from the second hydraulic pump 2 is fed to the swing motor 10 through the feeding/discharging path 18*b* and the pressure oil discharged from the feeding/discharging path 18*c* flows from an oil path 15*a* to the second return oil path 15 and is introduced into the back pressure circuit 16.

When a back pressure is developed by the back pressure check valve 16*a* in the back pressure circuit 16, the pressure oil in the second return oil path 15 is fed through the replenishing passage 17*a* to the swing motor 10 which is about to undergo cavitations.

If a bucket pulling operation is performed, the bucket control valve 6 is switched to the extending position b, whereby the pressure oil from the first hydraulic pump 1 is fed to the head-side oil chamber 5*a*. At this time, pressure oil discharged from a rod-side oil chamber 5*b* flows from an oil path 15*b* to the second return oil path 15 and is introduced into the back pressure circuit 16. In this case, a back pressure is also developed in the second return oil path 15, and when the head-side oil chamber 5*a* becomes somewhat negative in pressure, pressure oil is fed to the bucket cylinder 5 through a replenishing passage 17*b*, whereby the occurrence of cavitations is prevented.

If a boom lowering operation is performed, the pressure oil from the first hydraulic pump 1 is fed to a rod-side oil chamber 7*b* in the boom cylinder 7 through the retractive position f and the pressure oil discharged from the head-side oil chamber 7*a* flows from the dedicated return oil path 20 to the first return oil path 22. The return oil in this case is returned to the tank 14 without going through the back pressure check valve 16*a*, so that the pressure corresponding to the pressure developed by the back pressure check valve 16*a* is not developed and hence it is possible to diminish the loss of energy.

If an arm pushing operation is performed, the pressure oil from the first hydraulic pump 1 is fed to a rod-side oil chamber 12*b* in the arm cylinder 12 through the contractive position i of the arm control valve 13 and the pressure oil discharged from a head-side oil chamber 12*a* flows from the dedicated oil path 21 to the first return oil path 22. In this case, as in the operation of the boom cylinder 7, return oil is also returned to the tank 14 without going through the back pressure check valve 16*a*. Therefore, the pressure corresponding to the pressure developed by the back pressure check valve 16*a* is not developed, thus making it possible to diminish the loss of energy.

There sometimes is a case where a back pressure needs not to be generated in the return oil passing through the second return oil path 15. However the flow rate of the return oil passing through the second return oil path 15 is equal to or less than the flow rate of the pressure oil supplied by the hydraulic pump. Accordingly, the loss of energy caused by the generation of a back pressure in the second return oil path 15 is relatively small.

On the other hand, the pressure oil flowing through the first return oil path 22 is the return oil from the cylinder head side and the flow rate thereof is larger than that of the oil supplied by the pump. Consequently, even at the same back pressure, the loss of energy becomes larger on the basis of such flow rate ratio and an increase in back pressure based on an override characteristic of the back pressure check valve 16*a*. Thus, the energy loss diminishing effect resulting from not passing through the back pressure check valve 16*a* is significant.

In more particular terms, in the case of an actuator having equal incoming flow rate and outgoing flow rate as in the hydraulic motor 10, the outgoing flow rate does not exceed the incoming flow rate of oil fed from the hydraulic pump. However, in the case of a cylinder, the rod-side sectional area is smaller than the head-side sectional area and therefore, when the cylinder is operated in its retracting direction, the outgoing flow rate of oil flowing out from the head side becomes larger than the flow rate of oil fed from the hydraulic pump to the rod side.

This embodiment is configured so as to suppress the loss of energy for the pressure oil discharged from the cylinder head side which pressure oil exerts a great influence on the loss of energy.

In the cylinder retracting operation, since cavitations are difficult to occur, there is no obstacle to operation even if the back pressure check valve 16*a* is not provided in the first return oil path 22.

Figure 3:
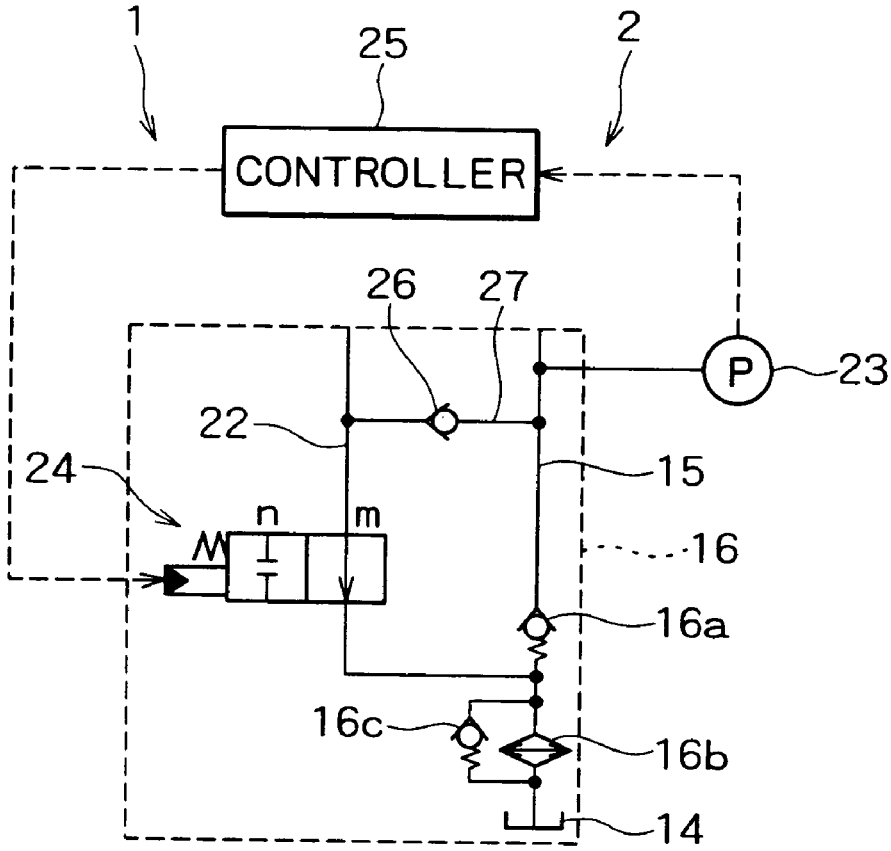
FIG. 3 is a circuit diagram of a principal portion, showing a modification of a back pressure circuit shown in FIG. 1.

FIG. 3 shows a modification of the back pressure circuit 16.

In the same figure, a pressure sensor 23 for detecting pressure of the second return oil path 15 is disposed in the same oil path. On the other hand, a flow control valve 24 (switching valve) having a communicating position (open position) m and a cut-off position (closed position) n is interposed in the first return oil path 22.

The pressure detected by the pressure sensor 23 is applied to a controller 25 as a switching valve control means, which in turn switches the flow control valve 24 in accordance with the detected pressure. An upstream side of the flow control valve 24 and the second return oil path 15 are connected with each other by a communicating path 27 through a check valve 26.

According to this configuration, after pressure of the second return path 15 is detected, when the detected pressure of the second return oil path 15 is below a predetermined value, the controller 25 switches the flow control valve 24 to the cut-off position n, whereby the pressure oil flowing through the first return oil path 22 can be replenished to the second return oil path 15 side.

Thus, when a composite operation is performed and the required flow rate of pressure oil fed from the second return oil path 15 for example through the replenishing passage 17*a* to an actuator about to undergo cavitations becomes large, a back pressure can be developed in the first return oil path 22. By replenishing the pressure oil in the first return oil path 22 to the second return oil path 15 it is possible to ensure the required flow rate.

Thus, it is preferable to provide an auxiliary replenishing means for replenishing the back pressure developed in the first return oil path 22 to the second return oil path 15 when the pressure of the second return oil path 15 drops.

Preferably, the auxiliary replenishing means comprises the flow control valve 24 disposed in the first return oil path 22 and functioning as a switching valve adapted to switch between the open position m and the closed position n, the communicating path 27 for communicating the upstream side of the switching valve to that of the back pressure check valve 16*a*, and the controller 25 as a switching valve control means for controlling the flow control valve 24. Preferably, the controller 25 is configured in such a manner that, when the pressure of the second return oil path 15 drops, the flow control valve 24 is closed, allowing a back pressure to be developed in the first return oil path 22, and the back pressure thus developed in the first return oil path 22 is replenished to the second return oil path 15 through the communicating path 27. According to this configuration, when the required flow rate of pressure oil to be fed to an actuator about to undergo cavitations becomes large, it is possible to replenish the back pressure in the first return oil path 22 to the second return oil path 15 and thereby ensure the required flow rate.

Figure 4:
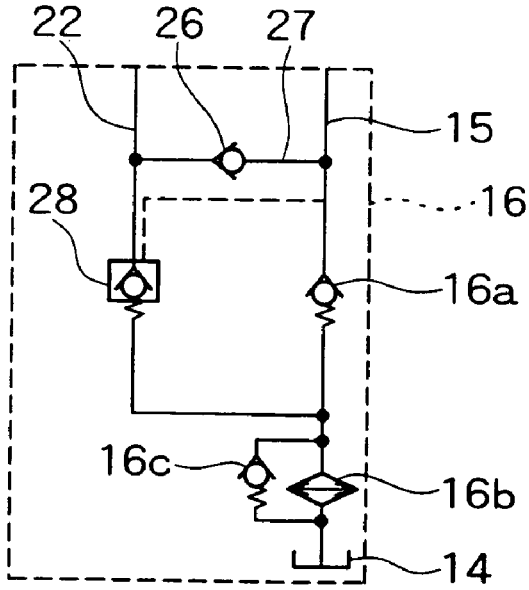
FIG. 4 is a circuit diagram of a principal portion, showing another modification of the back pressure circuit shown in FIG. 1.

FIG. 4 shows another modification of the back pressure circuit 16.

As to the same constituent elements as in FIG. 3, they are identified by the same reference numerals as in FIG. 3, and explanations thereof will be omitted.

In the back pressure circuit 16 shown in FIG. 4, a variable pressure check valve 28 is provided in the first return oil path 22 instead of the flow control valve 24 and is configured so as to be opened and closed with the oil pressure of the second return oil path 15.

According to this configuration, when the oil pressure of the second return oil path 15 drops, the variable pressure check valve 28 is closed and a back pressure is developed in the first return oil path 22, whereby the pressure oil in the first return oil path 22 can be joined to the second return oil path 15. Thus, without the need for any sensor or controller, the first return oil path 22 and second return oil path 15 can be joined when required.

In connection with this configuration, an auxiliary replenishing means is provided. Preferably, the auxiliary replenishing means comprises the check valve 28 disposed in the first return oil path 22 and adapted to be opened and closed in accordance with the oil pressure of the second return oil path 15 as a pilot pressure and the communicating path 27 for communicating the upstream side of the check valve 28 to that of the back pressure check valve 16*a*, and is configured in such a manner that, when the pressure of the second return oil path 15 drops, the check valve 28 closes, allowing a back pressure to be developed in the first return oil path 22, and the back pressure thus developed in the first return oil path 22 is replenished to the second return oil path 15 through the communicating path 27. Thus, when the required flow rate of pressure oil to be fed to an actuator about to undergo cavitations becomes large, the required flow rate can be ensured by a simple circuit configuration.

In the case where the above hydraulic control circuit is applied to a construction machine, the construction machine comprises as the hydraulic actuators the bucket cylinder 5, arm cylinder 12 and boom cylinder 7 provided in the front attachment and the swing motor 10 for rotating the upper rotating body, wherein the first return passage 22 is provided in the respective cylinders 5, 7, 12, and when any of the hydraulic cylinders and the swing motor 10 are operated simultaneously, return oil from the swing motor 10 and return oil on the rod side of the hydraulic cylinder are returned to the tank 14 through the second return passage 15 to develop a back pressure, while return oil on the head side of the hydraulic cylinder is returned to the tank 14 through the first return passage 22 so as not to develop a back pressure.

According to this construction machine, even when the respective hydraulic cylinders in the front attachment are operated in a composite manner, a back pressure is developed to prevent cavitations as to a hydraulic cylinder operated in its extending direction, while as to a hydraulic cylinder operated in its retracting direction, the loss of energy can be diminished without developing a back pressure.

Although the invention has been described with reference to the preferred embodiments in the attached figures, it is noted that equivalents may be employed and substitutions made herein without departing from the scope of the invention as recited in the claims.

We claim:

1. A hydraulic control system comprising:

a hydraulic pump;

control valves for controlling a direction and flow rate of pressure oil discharged from said hydraulic pump;

hydraulic actuators which the pressure oil is fed to and controlled by said control valves, said hydraulic actuators comprising hydraulic cylinders and a hydraulic motor; and a return passage adapted to conduct return oil from said hydraulic actuators to a tank, said return passage comprising:

a first return passage adapted to conduct return oil present at a head side of one of said hydraulic cylinders to said tank, said first return passage being in communication with said tank; and a second return passage adapted to conduct return oil from each of the other hydraulic actuators including said hydraulic motor except for said one of said hydraulic cylinders to the tank, said second return passage having a back pressure check valve and a replenishing passage, said replenishing passage providing a back pressure developed by said back pressure check valve to a lower pressure side of said each of the other hydraulic actuators.

2. The hydraulic control system according to claim 1, wherein a switching passage is formed within each of said control valves, said switching passage conducting return oil present at the head side of one of said hydraulic cylinders to said first return passage when a switching position of one of said control valves lies at a position for retracting said one of the hydraulic cylinders.

3. The hydraulic control system according to claim 1, further comprising:

an auxiliary replenishing means for providing a back pressure developed in said first return passage to said second return passage when an oil pressure of said second return passage drops.

4. The hydraulic control system according to claim 3, wherein said auxiliary replenishing means comprises a switching valve disposed in said first return passage and adapted to switch between an open position and a closed position, a communicating path for communicating an upstream side of said switching valve to an upstream side of said back pressure check valve, and a switching valve control means for controlling said switching valve, said switching valve control means being configured so as to close said switching valve when the oil pressure of said second return passage drops, and to cause a back pressure to be developed in said first return passage, and to provide the back pressure developed in said first return passage to said second return passage through said communicating path.

5. The hydraulic control system according to claim 3, wherein said auxiliary replenishing means comprises a check valve disposed in said first return passage and adapted to be opened and closed with the oil pressure of said second return passage as a pilot pressure and a communicating path for communicating an upstream side of said check valve to an upstream side of said back pressure check valve, said check valve being configured so as to be closed when the oil pressure of said second return passage drops to cause a back pressure to be developed in said first return passage, and to provide the back pressure developed in said first return passage to said second return passage through said communicating path.

6. A construction machine with the hydraulic control system described in claim 1, comprising as said hydraulic cylinders, a bucket cylinder, an arm cylinder, and a boom cylinder, said hydraulic cylinders being provided in a front attachment, and a swing motor for rotating an upper rotating body, wherein said first return passage is provided in each of said hydraulic cylinders, and when one of the hydraulic cylinders and said swing motor are operated simultaneously, return oil from said swing motor and return oil present at a rod side of said one of hydraulic cylinders are returned to said tank through said second return passage to develop a back pressure, while return oil at the head side of said one of said hydraulic cylinders is returned to said tank through said first return passage so as not to develop a back pressure.

* * * * *